United States Patent [19]

Tanaka

[11] 4,114,501

[45] Sep. 19, 1978

[54] MUSICAL TOY

[75] Inventor: Atsuo Tanaka, Tokyo, Japan

[73] Assignee: Tomy Kogyo Co., Inc., Tokyo, Japan

[21] Appl. No.: 732,406

[22] Filed: Oct. 14, 1976

[30] Foreign Application Priority Data

Oct. 20, 1975 [JP] Japan ..... 50-143001[U]

[51] Int. Cl.[2] ..... G10D 9/00

[52] U.S. Cl. ..... 84/330; 46/179

[58] Field of Search ..... 46/177, 179; 84/83, 84/330, 476

[56] References Cited

U.S. PATENT DOCUMENTS

| | | | |
|---|---|---|---|
| 2,879,685 | 3/1959 | Page | 84/470 |
| 3,002,318 | 10/1961 | Carver | 84/330 |

*Primary Examiner*—Lawrence R. Franklin

*Attorney, Agent, or Firm*—Staas & Halsey

[57] ABSTRACT

A musical toy consisting of a plurality of separately operated dolls each having a flexible bellows provided with an air chamber having an outlet, and a passageway connecting the opening of the bellows and the air chamber, the air chamber and passageway of each of the dolls being of a size to produce a pre-determined musical note, and wherein each of the dolls is also provided with indicia designating the note.

6 Claims, 28 Drawing Figures

MUSICAL TOY

BACKGROUND AND SUMMARY OF THE INVENTION

The present invention relates generally to musical toys, and particularly to a train within which there are located a plurality of musical "dolls," each of which is constructed to produce a selected sound of the musical scale. As the head of each doll is depressed by the child, the musical sound or note associated with that particular doll is emitted. The individual dolls may be color-coded to correspond to color-coded sheet music, and may bear the indicia "do," "re," "mi," etc. Moreover, the dolls may be arranged within the train in their musical sequence, although it is apparent that the dolls may be removed from the train and played with independently thereof.

DESCRIPTION OF THE PREFERRED EMBODIMENT

Figure 1:
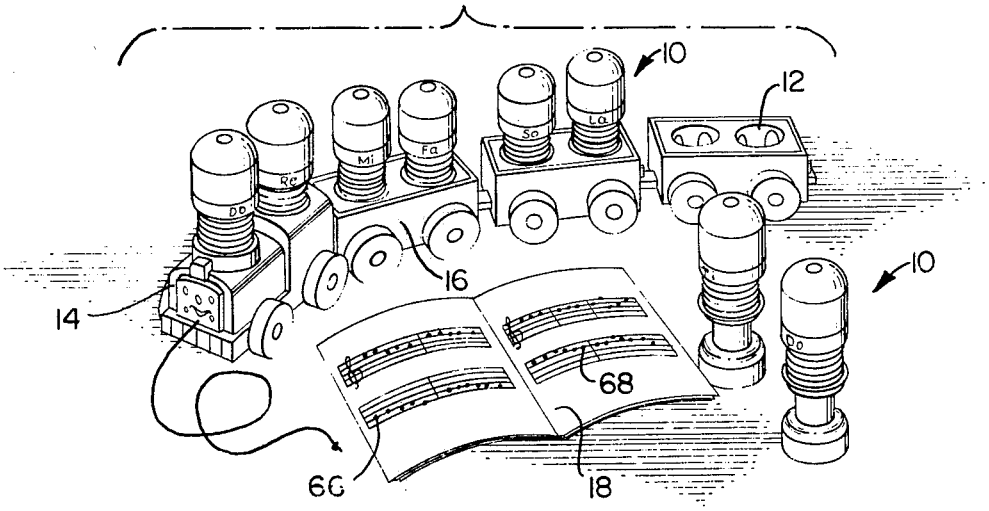
FIG. 1 is a perspective view illustrating the train within which the musical dolls are located and sheet music associated therewith.

The musical toy of the present invention is illustrated generally in FIG. 1 wherein it will be apparent that a plurality of musical dolls 10 are positioned within openings 12 provided within a toy locomotive 14 and cars 16. The dolls are provided with the indicia "do," "re," "mi," "fa," "so," "la," "ti,"and "do." The operation of the musical dolls 10 in relationship to the above noted indicia and the color-coded sheet music 18 will be explained hereinafter.

Figure 2:
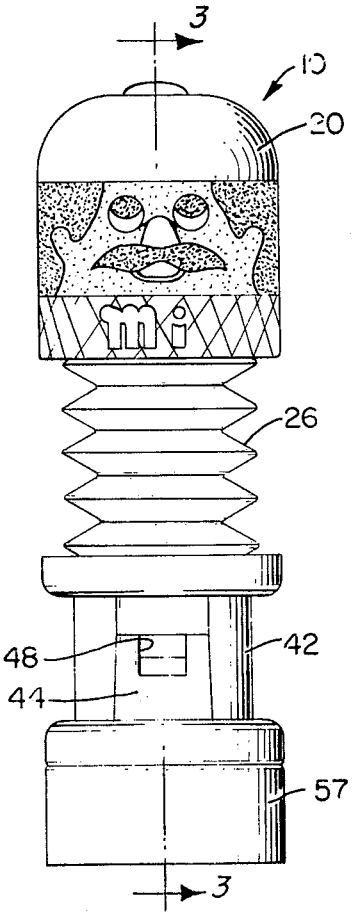
FIG. 2 is a front elevational view of one of the musical dolls.
Figure 3:
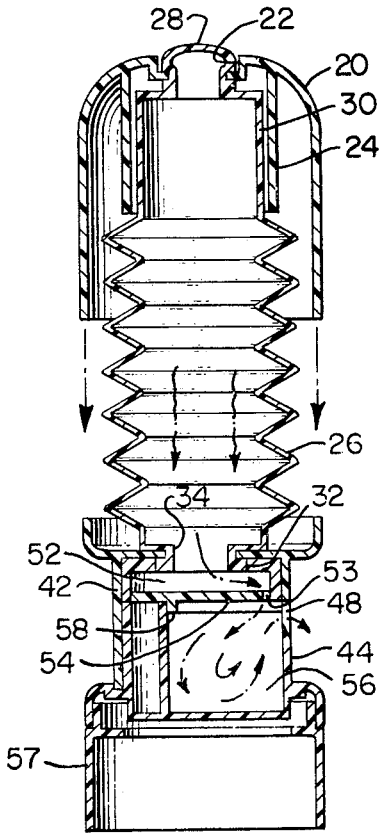
FIG. 3 is a sectional view taken along Line 3—3 of FIG. 2 illustrating the operating components of one of the dolls.
Figure 4:
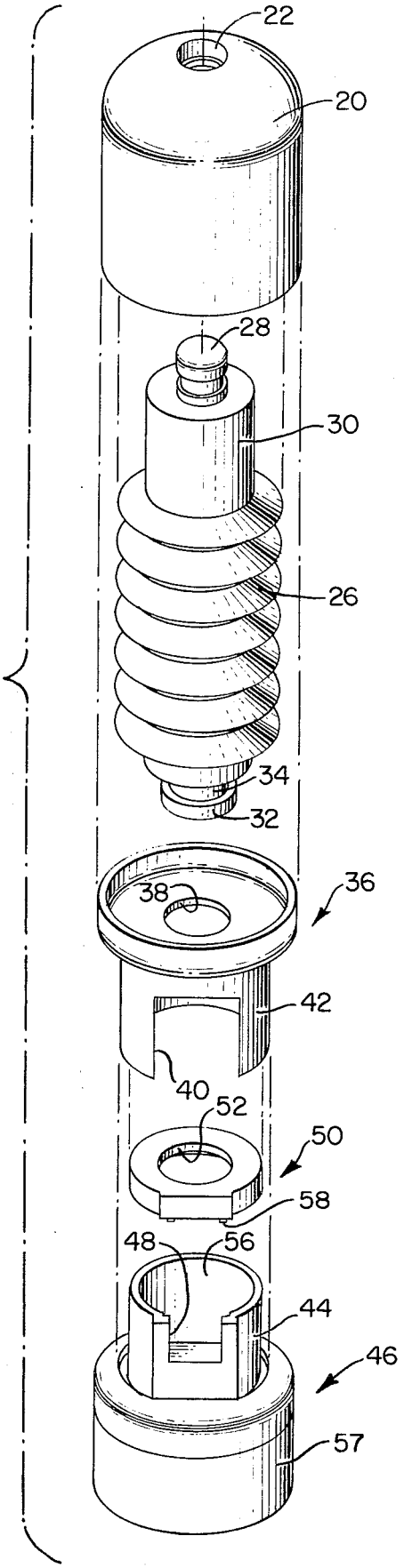
FIG. 4 is an exploded perspective view illustrating the components of one of the dolls.
Figure 5:
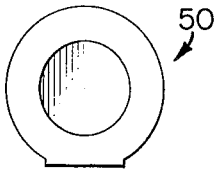
FIGS. 5, 8, 11, 14, 17, 20, 23, and 26 are top plan views of the sound discs associated with the dolls.
Figure 8:
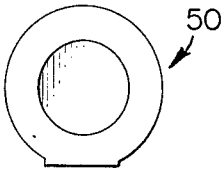
Figure 11:
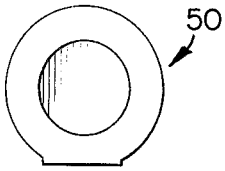
Figure 14:
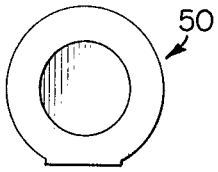

Turning now to FIGS. 2–4, it will be apparent that each of the dolls 10 is provided with a head 20 which is provided at the top thereof with an opening 22 and an internal downwardly depending cylindrical wall 24. A flexible, hollow bellows mechanism 26 is provided at the top thereof with a knob 28 which may be pressed upwardly through the opening 22, as illustrated in FIG. 3, to secure the bellows 26 to the head 20 at which time the cylindrical wall 30 of the bellows 26 is supported by the cylindrical wall 24 of the head 20. The bellows 26 terminates downwardly in a circular flange 32 which extends outwardly from the neck 34 such that the bellows 26 is secured to the upper housing 36 by urging the circular flange 32 through the opening 38 located in the top of the upper housing 36 at which time the circular flange 32 is located immediately below the opening 38, as illustrated in FIG. 3. The upper housing 36 is provided with a window 40. As will be further apparent from FIG. 4, the cylindrical side wall 42 of the upper housing 36 is complimentary in configuration with respect to the cylindrical wall 44 of the lower housing 46. Within the cylindrical wall 44 of the lower housing 46 there is also provided a window 48. Thus, when the upper and lower housings 36 and 46 are assembled, as illustrated in FIG. 2, a part of the window 48 of the lower housing 46 remains exposed. Interposed between the upper and lower housings 36 and 46, respectively, is a sound disc or diaphram 50 which is provided with a cavity 52. It will be apparent from FIG. 3 that when the components are assembled, the opening in the bellows 26 at the bottom of the circular flange 32 is in communication with the cavity 52 of the disc 50. Moreover, there is provided within the disc 50 a narrow slit designated by the reference numeral 53 which passes through the wall 54 of the disc 50 into the cavity 52. The lower housing 46 is hollow thus defining an air chamber or cavity 56. Thus, air leaving the bellows 26, after compression thereof, is forced outwardly through the opening defined by the circular flange 32 into the cavity 52 of the disc 50 and thus downwardly through the slit 53 into the relatively large cavity or air chamber 56 within the lower housing 46 and eventually outwardly through the window 48. Depending from the lower housing 46 is a base designated by reference numeral 57.

Figure 6:
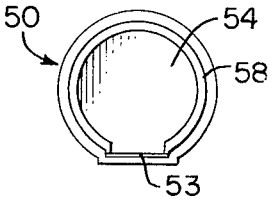
FIGS. 6, 9, 12, 15, 18, 21, 24, and 27 are bottom plan views of the sound discs associated with the dolls.
Figure 9:
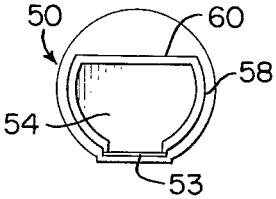
Figure 12:
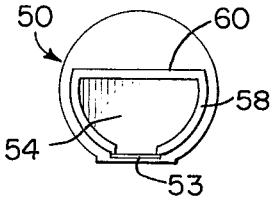
Figure 15:
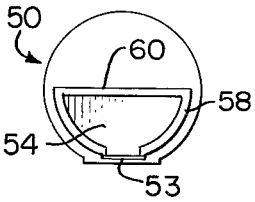
Figure 7:
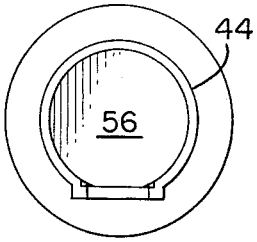
FIGS. 7, 10, 13, 16, 19, 22, 25, and 28 are top plan views of the base portions of the dolls upon which the corresponding sound discs are positioned.
Figure 10:
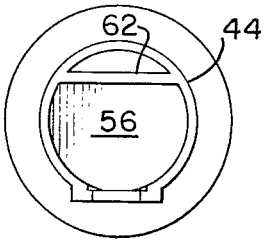
Figure 13:
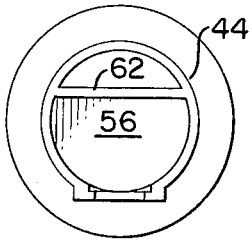
Figure 16:
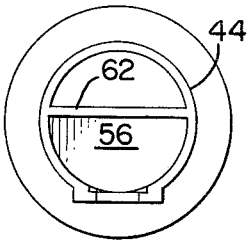
Figure 17:
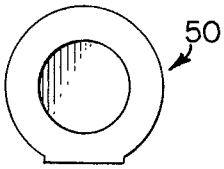
Figure 20:
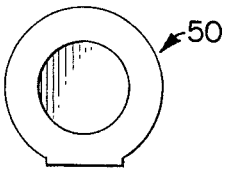
Figure 23:
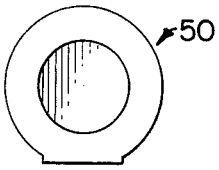
Figure 26:
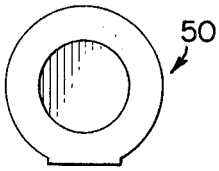
Figure 18:
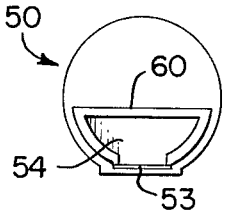
Figure 21:
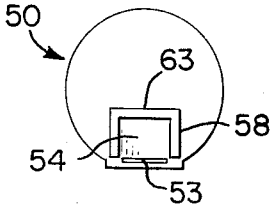
Figure 24:
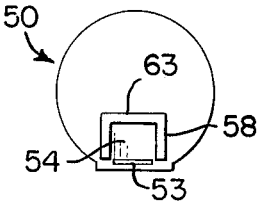
Figure 27:
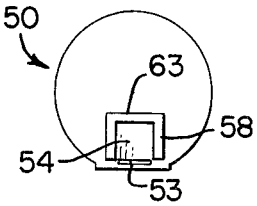
Figure 19:
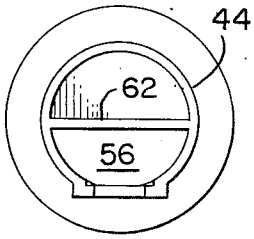
Figure 22:
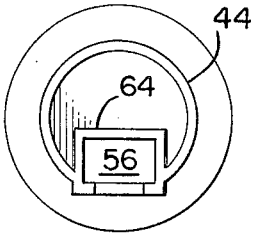
Figure 25:
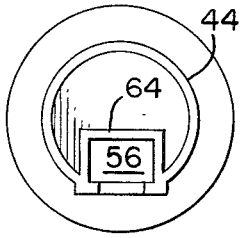
Figure 28:
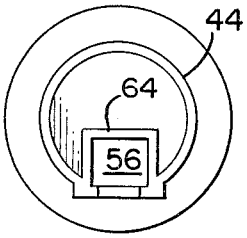

The sounds emitted from the dolls 10 depend upon the size of the air chambers 56 defined by the cylindrical wall 44 of the lower housing 46 and the size of the slit 53. More specifically, the larger the capacity of the air chamber 56 and the slit 53 the lower the pitch of the sound. Sounds ranging from the lower "do" to the upper "do" are obtained by the arrangements illustrated in FIGS. 5–27 wherein it will be apparent that the underneath side of each of the diaphrams 50, as illustrated in FIGS. 6, 9, 12, 15, 18, 21, 24, and 27 is provided with a ridge 58 that is complimentary to the configuration of the top of the cylindrical wall 44 of the lower housing 46 such that the ridge 58 abuts the internal wall surface of the cylindrical wall 44. With reference to FIGS. 6 and 7, for example, the ridge 58 of the diaphram 50 is designed to fit along the inside of the generally cylindrical wall 44 in such manner as to define an air chamber 56 which consists of the entirety of the cavity defined by the cylindrical wall 44. But where the size of the air chamber 56 must be smaller in dimension, to achieve a higher pitch, such as illustrated in FIGS. 9 and 10, for example, the ridge 58 is provided with a straight section 60 which extends across the diaphram 50 so as to divide the area of same into two parts. The straight section 60 of the ridge 58 (FIG. 9) is thus complimentary in configuration to the partition 62 which is provided across the cylindrical wall 44 of the lower housing 46, as illustrated in FIG. 10, dividing the area defined by the cylindrical wall 44 into two paths. Thus, as the diaphram 50 is fitted in place over the cylindrical wall 44 the volume of the cavity or air chamber 56 is reduced. The same is true with respect to the different diaphrams and lower housing structures illustrated in the remaining figures. By adjusting the position of the straight sections 60 of the ridges 58 of the diaphrams 50 to coincide with the positions of the partitions 62 of the lower housings 46 it is apparent that the effective area of the air chambers 56 is varied. Turning now to FIGS. 21, 24, and 27 it will be apparent that to achieve even smaller air chambers 56 the diaphrams 50 are provided with ridges 58 consisting entirely of straight sections 63 defining small rectangles which are complimentary in configuration to the vertical walls 64 formed within the cylindrical walls 44 of the lower housings 46. In a manner similar to that described above, the diaphrams 50 are fitted on top of the cylindrical walls 44 such that the rectangular shaped ridges 58 fit within the top portions of the rectangular shaped partition walls 64.

From the foregoing, it will be apparent that a variety of amusement functions may be performed with the musical toy of the present invention. It is possible for the child to load the loco 14 and cars 16 with the music dolls 10 and play with the so-assembled train. A child of a very young age will derive amusement from merely pulling the loco and on occasion depressing the heads 20 of selected of the dolls 10 to produce sounds at random. The dolls 10 may be arranged in the fashion illustrated in FIG. 1 with their "do," "re," etc. indicia in order of sound and the child may experiment with playing various tunes. With the sheet music instruction 18, which includes notes 66 and 68, for example, which are color-coded to correspond with the heads 20 of the dolls 10 that produce the corresponding note of the music scale, it is possible for the child to "read" music from the sheet 18 by depressing the appropriate color-coded head 20 to play different songs.

I claim:

1. A toy, comprising a plurality of sound producing mechanisms for producing different musical notes, each of said sound producing mechanisms having an upper portion with a bellows-like mechanism, a lower housing having an external wall with an opening therethrough and at least one internal wall surface, an upper housing complementary in configuration to said external wall of said lower housing and slidably mounted thereon, said bellows-like mechanism extending into said upper housing, a disc positioned between said upper and lower housings, said disc having a slit therethrough and at least one ridge on the bottom thereof located to abut said internal wall surface to define an air chamber in said lower housing, said plurality of sound producing mechanisms having the same size bellows-like mechanism, upper housing, lower housing and disc, the size of said slit and the location of said ridge and internal wall surface being selected to produce the particular note of each of sound producing mechanisms whereby each of said sound producing mechanisms may be manufactured by assembling all elements except said disc and lower housing from a common stock pile of parts, said disc and lower housing being individually selected for the note desired.

2. A toy as in claim 1, wherein said internal wall surface of one of said sound producing mechanisms is generally circular in cross-section, and said ridge of said disc associated therewith is generally circular in cross-section.

3. A toy as in claim 2, wherein said internal wall surfaces of other of said sound producing mechanisms include portions that are generally circular in cross-section and generally straight partitions intersecting said generally circular portions at different positions, and said ridges of said discs associated therewith include portions that are generally circular in cross-section corresponding to said generally circular portions of said internal wall surfaces and generally straight portions corresponding to said generally straight portions of said internal wall surfaces.

4. A toy as in claim 3, wherein said internal wall surfaces of still other of said sound producing mechanisms include generally straight sections of different sizes intersecting each other to define a rectangle in cross-section, and said ridges of said discs associated therewith include generally straight sections corresponding to said straight sections of said internal wall surfaces.

5. A toy as in claim 1, wherein said upper portions of said sound producing mechanisms comprise heads provided with indicia thereon designating the musical notes produced thereby.

6. A toy as in claim 5, wherein said indicia on said heads comprise the words "do," "re," "mi," "fa," "so," "la," "ti" and "do" on different of said sound producing mechanisms corresponding to said notes produced thereby.

* * * * *